US009104156B2

(12) United States Patent
Suzuki et al.

(10) Patent No.: US 9,104,156 B2
(45) Date of Patent: Aug. 11, 2015

(54) FIXING DEVICE AND IMAGE FORMING APPARATUS INCORPORATING SAME

(71) Applicants: Akira Suzuki, Tokyo (JP); Takuya Seshita, Kanagawa (JP); Takahiro Imada, Kanagawa (JP); Hajime Gotoh, Kanagawa (JP); Kensuke Yamaji, Kanagawa (JP)

(72) Inventors: Akira Suzuki, Tokyo (JP); Takuya Seshita, Kanagawa (JP); Takahiro Imada, Kanagawa (JP); Hajime Gotoh, Kanagawa (JP); Kensuke Yamaji, Kanagawa (JP)

(73) Assignee: Ricoh Company, LTD., Tokyo (JP)

( * ) Notice: Subject to any disclaimer, the term of this patent is extended or adjusted under 35 U.S.C. 154(b) by 0 days.

(21) Appl. No.: 14/189,238

(22) Filed: Feb. 25, 2014

(65) Prior Publication Data

US 2014/0255064 A1 Sep. 11, 2014

(30) Foreign Application Priority Data

Mar. 11, 2013 (JP) ..... 2013-047957

(51) Int. Cl.
*G03G 15/20* (2006.01)

(52) U.S. Cl.
CPC ..... *G03G 15/2085* (2013.01); *G03G 15/2025* (2013.01); *G03G 15/2028* (2013.01); *G03G 15/2035* (2013.01)

(58) Field of Classification Search
CPC ..... G03G 15/2075; G03G 15/2085
USPC ..... 399/323, 327, 329
See application file for complete search history.

(56) References Cited

U.S. PATENT DOCUMENTS

| | | | | |
|---|---|---|---|---|
| 6,219,521 | B1 * | 4/2001 | Burdick et al. | 399/327 |
| 6,243,558 | B1 * | 6/2001 | Oota | 399/327 X |
| 7,702,271 | B2 * | 4/2010 | Yamada et al. | 399/327 |
| 2011/0044734 | A1 | 2/2011 | Shimokawa et al. | |
| 2011/0222926 | A1 | 9/2011 | Ueno et al. | |
| 2012/0207523 | A1 | 8/2012 | Ueno et al. | |
| 2013/0170877 | A1 | 7/2013 | Yoshiura et al. | |
| 2013/0209147 | A1 | 8/2013 | Ogawa et al. | |
| 2013/0236225 | A1 | 9/2013 | Ogawa et al. | |

FOREIGN PATENT DOCUMENTS

| | | |
|---|---|---|
| JP | 2004-286922 | 10/2004 |
| JP | 2005-092080 | 4/2005 |
| JP | 2008-158152 | 7/2008 |
| JP | 2010-217466 | 9/2010 |
| JP | 2011-174955 | 9/2011 |
| JP | 2012-103402 | 5/2012 |
| JP | 2012-103552 | 5/2012 |

* cited by examiner

*Primary Examiner* — Sandra Brase
(74) *Attorney, Agent, or Firm* — Harness, Dickey & Pierce, P.L.C.

(57) ABSTRACT

A fixing device to fix an unfixed image carried on a recording medium includes an endless, rotary fixing member; a heat source to heat the fixing member; an opposed member disposed opposite the fixing member and to form a fixing nip in combination with the fixing member; and a biasing member disposed opposite the opposed member with the fixing member interposed therebetween, to press the fixing member from a back side of the fixing member against the opposed member at the fixing nip; grip portions at which the fixing member and the opposed member contact each other in areas through which the recording medium does not pass, among the fixing nip along a direction perpendicular to a conveyance direction of the recording medium; and a cleaning member to clean an outer circumference of at least one of the grip portions of the fixing member and the opposed member.

20 Claims, 8 Drawing Sheets

FIXING DEVICE AND IMAGE FORMING APPARATUS INCORPORATING SAME

CROSS-REFERENCE TO RELATED APPLICATION

The present application claims priority pursuant to 35 U.S.C. §119 from Japanese patent application number 2013-047957, filed on Mar. 11, 2013, the entire disclosure of which is incorporated by reference herein.

BACKGROUND

1. Technical Field

The present invention relates to a fixing device to perform fixation of unfixed images carried on a recording medium by passing the medium though a fixing nip, and further relates to an image forming apparatus incorporating such a fixing device, such as a copier, a printer, a facsimile machine, a plotter, or a multi-function apparatus having one or more of these capabilities.

2. Related Art

Demand for faster, more energy-efficient image forming apparatuses such as printers, copiers, and facsimile machines is acute.

In these types of image forming apparatuses, a toner image is formed by image forming processes such as electrophotographic recording, electrostatic recording, magnetic recording, and the like. The toner image is then transferred onto a sheet such as a sheet of paper, a printed sheet, a photosensitive paper, or a dielectric-coated paper (hereinafter, simply also "recording medium"), via an indirect transfer method or a direct transfer method.

As a fixing device to fix an unfixed toner image, fixing devices employing a contact heating method are widely used. These methods include a heat-roller method, a film or belt heating method, and an electro-magnetic induction heating method.

Of these methods, a thin fixing member having a low thermal capacity is optimal for reducing both warm-up time of the fixing device and power consumption. Herein, "warm-up time" means a length of time that the fixing device takes to heat up from room temperature when power is turned on up to a predetermined temperature, i.e., a reload temperature, capable of performing printing. JP-2004-286922-A discloses a fixing device employing a belt as an example.

Regarding the fixing devices employing a belt, there is demand for a further reduction of both warm-up time and of first-print time. Herein, "first-print time" means the time it takes, after receipt of a print request, to print out a sheet. However, the faster the printing speed, the number of prints per unit time increases and a required heat quantity increases drastically. In particular, there is not enough heat at the start of continuous printing, that is, a temperature drop is a problem.

To solve the above problem, JP-2005-092080-A discloses a fixing device employing an endless belt, in which the entire belt is heated. With this structure, the first-print time from a standby time can be shortened and the heat shortage in high-speed printing can be prevented. As a result, if mounted on a high-speed image forming apparatus, such a fixing device provides optimal image fixability.

Most fixing devices employing such a fixing belt are configured to rotate driven by a pressure roller disposed opposite the fixing belt. More specifically, the fixing belt is pressed by the rotating pressure roller and the fixing belt rotates together with the pressure roller because the force of friction exceeds the torque required to rotate the fixing belt. Thus, the fixing belt rotates driven by the pressure roller.

In such a fixing device, if the force of friction that the fixing belt receives from the pressure roller is below the torque required to rotate the fixing belt, the fixing belt slips at the fixing nip. As a result, the fixing belt cannot rotate anymore and stops. In particular, if the coefficient of friction of the surface of the recording medium which passes through the fixing nip is small, the fixing belt receiving friction from the pressure roller when the recording medium is sandwiched between the pressure roller and the fixing belt is reduced compared to a state in which no recording medium is supplied.

JP-2005-092080-A discloses a fixing device in which the fixing belt is configured to slide on the biasing member that presses the fixing belt against the pressure roller, so that the fixing belt receives a greater sliding friction from the biasing member. As a result, a rotary torque of the fixing belt becomes large, which causes slipping.

As a method to prevent the above problem, one approach involves increasing the force of friction exerted by the pressure roller. JP-2012-103402-A discloses a structure that disposes a grip portion at both ends of the pressure roller and the fixing belt. The grip portion allows the pressure roller and the fixing belt to contact each other without intercession of the recording medium even while it is being conveyed, and the force of friction exerted on an outer circumferential surface of the grip portion is maintained at a certain level or more. With this structure, the slipping of the fixing belt can be prevented regardless of the coefficient of friction of the recording medium.

However, although such a slipping prevention method is applied to the fixing device, the force of friction that the fixing belt receives from the pressure roller is reducing with time in the continued use of the fixing device. If the force of friction received from the pressure roller is reduced, the slipping of the fixing belt tends to occur. In particular, foreign particles such as powdery dust or oil attached to the surface of the fixing belt or the pressure roller are a problem. In this case, the sheet serves to clean the fixing belt and the pressure roller and removes the foreign particles therefrom in the area through which the recording medium passes.

On the other hand, in an area of the fixing belt and/or the pressure roller on or over which the recording medium is not conveyed, the foreign particles attached to the fixing belt or the pressure roller are not removed and so gradually accumulate. Such foreign particles reduce the coefficient of friction of the fixing belt or the pressure roller at the fixing nip and reduce the force of friction that the fixing belt receives from the pressure roller. As a result, slipping tends to occur when the recording medium passes though the fixing nip.

To cope with this problem, JP-2011-174955-A discloses a structure to dispose a shutter member on the surface of the pressure roller. The shutter member prevents an inflow of the foreign particles from the sheet-passing area to the non-sheet-passing area. As a result, the force of friction that the fixing belt receives from the pressure roller is prevented from being reduced even with continued operation of the fixing device.

However, flows of the foreign particles into the area through which the recording medium does not pass are not limited from the area through which the recording medium passes. The structure disclosed in t JP-2011-174955-A does not prevent foreign particles such as powdery dust or scattered toner floating inside the image forming apparatus from attaching to the fixing belt or the pressure roller in the area through which the recording medium does not pass. If the foreign particles attach to the non-sheet-passing area, the force of friction that the fixing belt receives from the pressure roller reduces. Once the force of friction is reduced, even the shutter member does not contribute to recovery of the force of friction.

SUMMARY

The present invention provides an improved fixing device capable of eliminating slipping of the fixing member, reducing warm-up time by providing a fixing member with a low thermal capacity, and sufficiently reducing the consumption of energy.

The fixing device includes an endless, rotary fixing member; a heat source to heat the fixing member; an opposed member disposed opposite the fixing member and configured to form a fixing nip in combination with the fixing member; and a biasing member disposed opposite the opposed member with the fixing member interposed therebetween, to press the fixing member from a back side of the fixing member against the opposed member at the fixing nip, wherein the fixing member slides along a contact surface with the biasing member. The opposed member rotates and the fixing member driven by the opposed member rotates so that the recording medium carrying the unfixed image is conveyed to the fixing nip and the unfixed image thereon is fixed onto the recording medium. The fixing device further includes grip portions at which the fixing member and the opposed member contact each other in areas through which the recording medium does not pass, among the fixing nip along a width direction perpendicular to a conveyance direction of the recording medium; and a cleaning member to clean an outer circumference of at least one of the grip portions of the fixing member and the opposed member.

These and other objects, features, and advantages of the present invention will become apparent upon consideration of the following description of the preferred embodiments of the present invention when taken in conjunction with the accompanying drawings.

BRIEF DESCRIPTION OF THE DRAWINGS

FIG. 2 is a cross-sectional view of a fixing device at an area where recording media pass through;

FIG. 3 is a cross-sectional view of the fixing device at an area where recording media do not pass through;

DETAILED DESCRIPTION

Preferred embodiments according to the present invention will now be described referring to accompanying drawings. A first embodiment will be described with reference to FIGS. 1 to 4.

Figure 1:
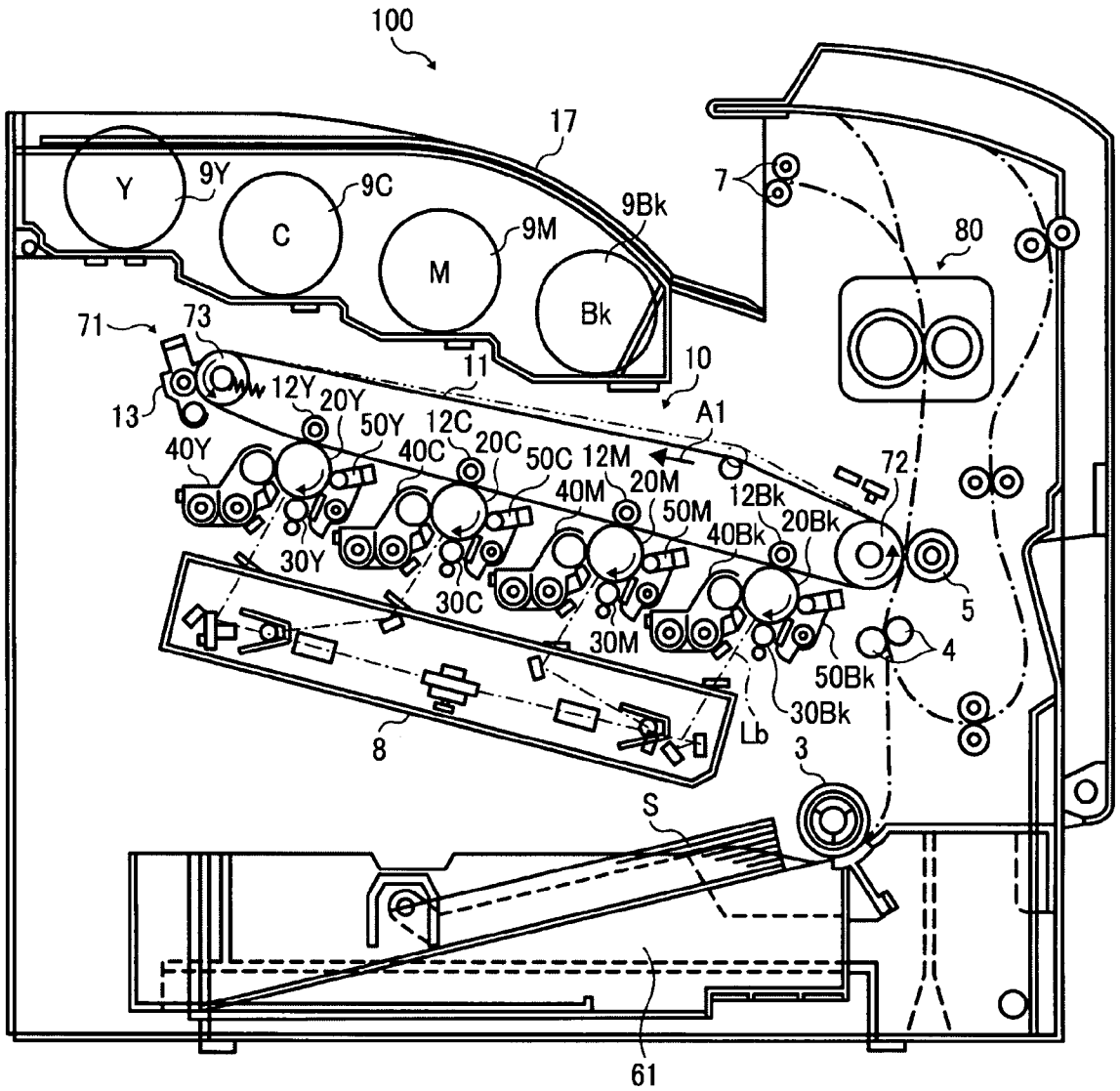
FIG. 1 is a schematic view of an image forming apparatus according to a first embodiment of the present invention.

FIG. 1 illustrates a schematic configuration of an image forming apparatus 100 according to the first embodiment of the present invention.

The image forming apparatus 100 is a tandem-type color printer, in which image forming units each forming a different color image, are aligned along an endless, rotatable intermediate transfer belt 11. The image forming apparatus 100 includes photoreceptor drums 20Y, 20C, 20M, and 20Bk as image carriers each forming an image of a color corresponding to a color decomposed from a print-target image; i.e., yellow, cyan, magenta, and black.

Each visible toner image formed on the photoreceptor drums 20Y, 20C, 20M, and 20Bk is transferred onto the intermediate transfer belt 11 opposite each photoreceptor drum in a direction indicated by Arrow A1 in a primary transfer operation in which each image is superimposed on the preceding one. Each visible image formed on each photoreceptor drum 20 is transferred to the intermediate transfer belt 11 in a superimposed manner at the same position on the intermediate transfer belt 11 while the intermediate transfer belt 11 is moving in direction A1. The primary transfer is performed by applying an electrical charged to a primary transfer roller disposed opposite each photoreceptor drum with the intermediate transfer belt 11 in between, and the timing of charging is staggered upstream to downstream in direction A1. The thus-transferred toner image is then secondarily transferred en bloc to a sheet S.

A structure of the photoreceptor drum 20Bk that performs image formation of black images is described as a representative, insofar as all the photoreceptor drums have the same structure and differ only in the color of toner disposed therein. Thus, around the photoreceptor drum 20Bk, a charger 30Bk, a developing device 40Bk, a primary transfer roller 12Bk, and a cleaning device 50Bk are disposed. An optical writing device 8 is used for writing the image after charging.

The photoreceptor drums 20Y, 20C, 20M, or 20Bk are disposed, in that order, from upstream to downstream in direction A1. Each photoreceptor drum 20Y, 20C, 20M, or 20Bk is mounted in a corresponding imaging station that forms images of the colors yellow, cyan, magenta, and black, respectively. An intermediate transfer belt unit 10 is disposed opposite and above the photoreceptor drum 20 and includes the intermediate transfer belt 11 and primary transfer rollers 12Y, 12C, 12M, and 12Bk. The image forming apparatus 100 further includes a secondary transfer roller 5, disposed opposite the intermediate transfer belt 11 and rotated by the rotation of the intermediate transfer belt 11, and a belt cleaning device 13, disposed opposite the intermediate transfer belt 11 to clean the surface of the intermediate transfer belt 11. The optical writing device 8 is disposed below the four imaging stations.

The optical writing device 8 includes a semiconductor laser as a light source, a coupling lens, an fθ lens, a toroidal lens, a folding mirror, and a polygon mirror as a deflection means. The optical writing device 8 emits a writing light Lb corresponding to each color to the photoreceptor drum 20 to form an electrostatic latent image on each photoreceptor drum 20. In FIG. 1, only the writing light Lb for the black imaging station is indicated, but the other imaging station is similarly configured.

A paper tray 61 is disposed in the bottom of the image forming apparatus 100. The paper tray 61 contains sheets of recording media S each of which is conveyed toward a portion between the photoreceptor drum 20 and the intermediate transfer belt 11. The sheet S conveyed from the paper tray 61 is sent, via a registration roller pair 4, to a transfer portion between the photoreceptor drum 20 and the intermediate transfer belt 11 at a predetermined time matched with the toner image formed by the imaging station. A sensor, not shown, detects that a leading end of the sheet S arrives at a registration roller pair 4.

The image forming apparatus 100 further includes a fixing device 80 employing a film fixing method and fixing the toner image transferred on the sheet S, and a sheet discharge roller pair 7 that discharges the sheet S on which the toner image is fixed thereon outside the image forming apparatus.

A sheet discharge tray 17 on which recording sheets S are stacked is disposed on an upper surface of the image forming apparatus. Toner bottles 9Y, 9C, 9M, and 9Bk each containing toner of one of colors yellow, cyan, magenta, and black are disposed below the sheet discharge tray 17.

The intermediate transfer belt unit 10 includes, in addition to the intermediate transfer belt 11 and the primary transfer rollers 12Y, 12C, 12M, and 12Bk, a drive roller 72 and a driven roller 73, around both of which the intermediate transfer belt 11 is stretched. The driven roller 73 serves as a tension applying member against the intermediate transfer belt 11. Thus, a biasing member employing, for example, a spring is provided to the driven roller 73.

Together, the intermediate transfer belt unit 10, the primary transfer rollers 12Y, 12C, 12M, and 12Bk, the secondary transfer roller 5, and the intermediate transfer belt cleaning device 13 constitute a transfer device 71.

The paper tray 61 includes a sheet feed roller 3 that contacts an upper surface of the topmost sheet S. When the sheet feed roller 3 rotates in the counterclockwise direction, the topmost sheet S is caused to be conveyed to the registration roller pair 4.

The intermediate transfer belt cleaning device 13 disposed in the transfer device 71 includes a cleaning brush and a cleaning blade, both of which are disposed opposite the intermediate transfer belt 11 so as to contact it. The cleaning brush and the cleaning blade of the intermediate transfer belt cleaning device 13 scrape and remove foreign particles such as residual toner remaining on the intermediate transfer belt 11. The intermediate transfer belt cleaning device 13 also includes a discharging means, not shown, to collect and waste the residual toner removed from the intermediate transfer belt 11.

Structure of the fixing device 80 will be described in detail referring to FIGS. 2 to 4.

Figure 2:
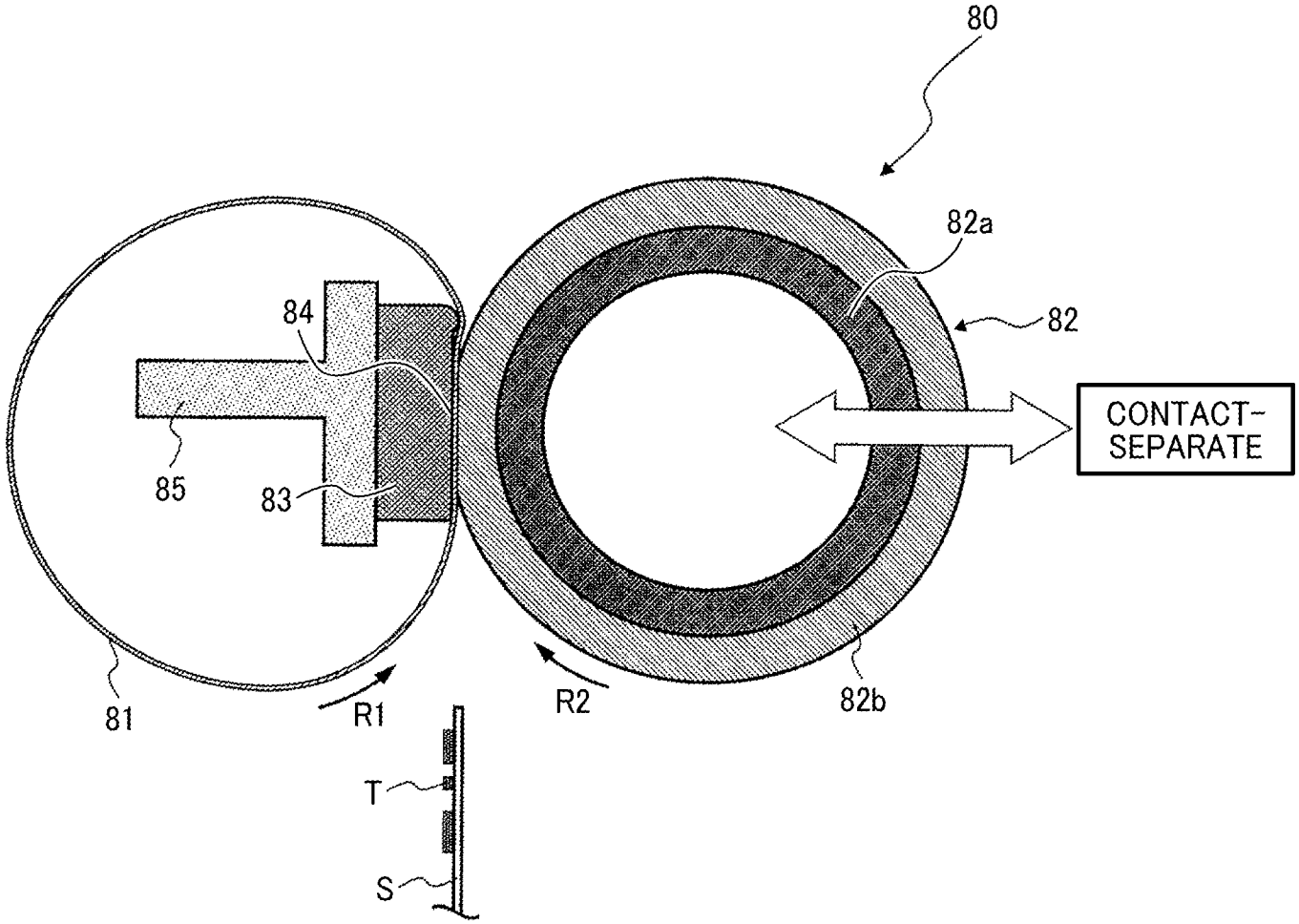
Figure 3:
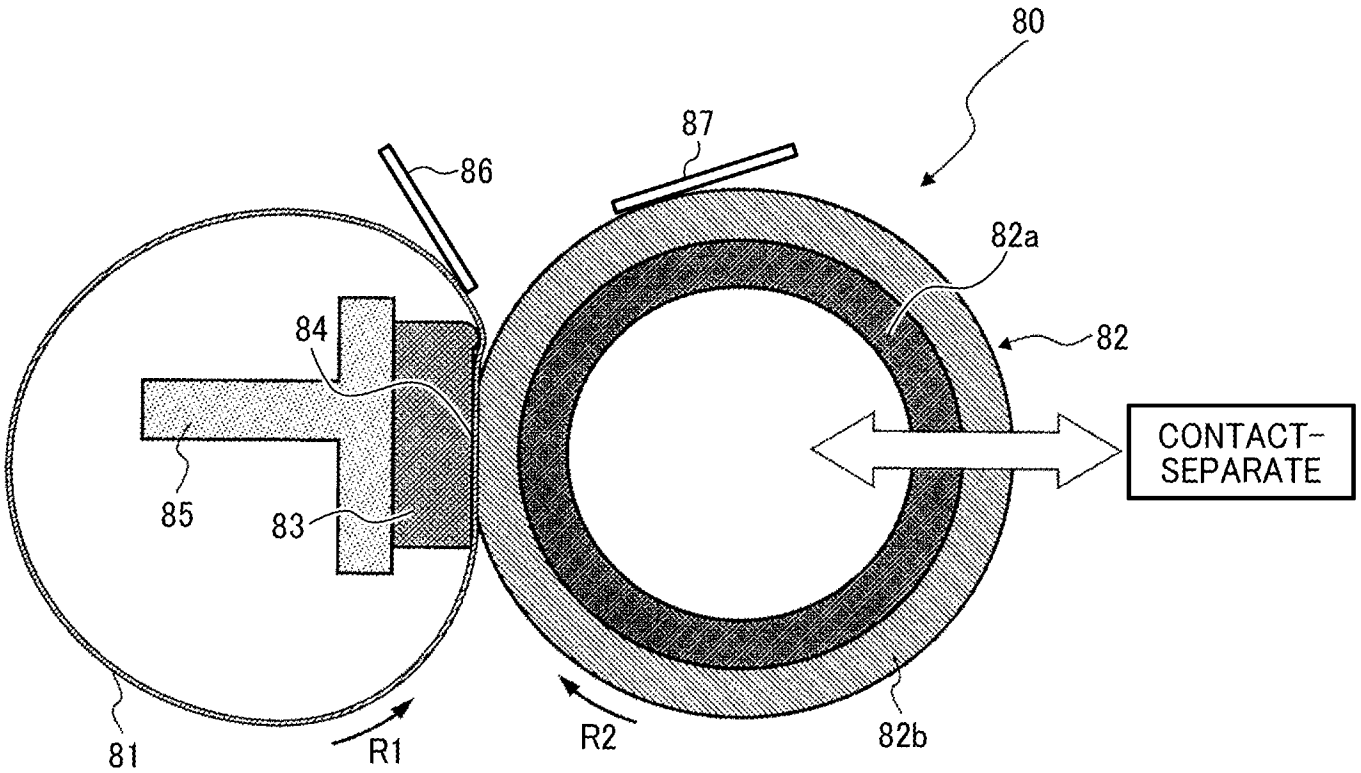

FIG. 2 is a cross-sectional view of the fixing device at an area D through which the recording medium passes and FIG. 3 is a cross-sectional view at areas G1 and G2 through which the recording medium does not pass.

A flexible, endless fixing belt 81 as a rotatable fixing member is disposed opposite a rotary pressure roller 82. A biasing member 83 presses the pressure roller 82 from the back side of the fixing belt 81, so that a fixing nip 84 is formed between the fixing belt 81 and the pressure roller 82. Specifically, the biasing member 83 is opposed to the pressure roller 82 with the fixing belt 81 interposed therebetween, and presses the fixing belt 81 at the fixing nip against the pressure exerted by the pressure roller 82. A brace 85 is disposed to prevent the biasing member 83 from deforming due to reaction force when the biasing member 83 presses the fixing belt 81.

When the pressure roller 82 rotates in R2 direction, frictional force is applied to the fixing belt 81 in the fixing nip 84, and as a result, the fixing belt 81 is driven to rotate in R1 direction. The sheet S carrying the unfixed toner image T thereon is conveyed by the rotation of the fixing belt 81 and the pressure roller 82 to the fixing nip 84 between the fixing belt 81 and the pressure roller 82, where the fixing belt 81 and the pressure roller 82 apply heat and pressure to the toner image T carried on the sheet S, and thus, the toner image T is fixed onto the sheet S.

A heat source supplies heat to the toner image T at the fixing nip 84. The heat source is mounted inside the fixing belt 81. As a heat source, for example, a halogen heater, an induction heating (IH) coil or a resistance heating element may be used. Preferably, the fixing belt 81 describes a circle having a diameter of from 15 to 120 mm when deployed and a preferred thickness of 1 mm or less considering the thermal capacity and the space inside the belt to contain facilities.

The fixing belt 81 is generally constructed of a base layer, an elastic layer, and a release layer from an interior side thereof, laminated in that order. However, when the IH coil is used as a heater for the endless belt, a heating layer is formed between the base layer and the elastic layer. The heating layer has an approximate thickness of 10 μm and preferred materials are metallic materials. Copper is in particular preferable. The heating layer generates heat by mutual induction heating from the IH coil.

Further, when such an IH heater does not show good performance related to image quality, a two-layer structure formed of the base layer and the release layer may be possible without using the elastic layer.

In the present embodiment, the fixing belt 81 is configured to have a diameter of 25 mm and includes the base layer, the elastic layer, and the release layer. Preferred materials for the base layer are resins such as polyimide or metals such as nickel and stainless steel having a thickness of from 20 to 100 μm to provide both flexibility and rigidity. In addition, in order to improve slidability with the biasing member 83 and absorptivity of radiation heat from an interior side, it is preferred that coating material is coated on an interior surface of the base layer. Preferred coating material is fluorine resins to improve slidability, but blackening is also preferred to improve absorptivity of the radiation heat.

The elastic layer preferably has a thickness of from 50 to 300 μm and is formed of elastic materials such as a silicon rubber. Even though there is concavity and convexity on the surface of the recording medium and the endless belt, and pressing force and thermal conductivity become uneven in the fixing nip 84, uneven pressure force and thermal conductivity may be ameliorated by the elastic layer.

The release layer has a thickness of from 3 μm to 50 μm and employs a material that exerts high releaseability of the toner and recording medium. Preferred materials therefor include, for example, fluorine resins such as tetrafluoroethylene-perfluoroalkyl vinylether copolymer (PFA), polytetrafluoroethylene (PTFE), polyimide, polyetherimide, and polyethersulfide (PES).

The fluorine resins such as PFA and PTFE are in particular preferable due to a low coefficient of friction and optimal toner releaseability. In the present embodiment, the release layer is formed of PFA with a thickness of 20 μm.

The pressure roller 82 includes a metal core 82*a* formed of metallic materials and an elastic layer 82*b* formed of elastic materials such as foamed silicon rubber. Although not shown, when a release layer formed of fluorine resins such as PFA or PTFE and having a thickness of from 10 to 70 μm is disposed on an outer circumference of the elastic layer, releaseability of toner and recording medium can be improved. The release layer according to the embodiment of the present invention has a diameter of 25 mm and is formed of PFA with a thickness of 50 μm.

Specifically, the biasing member 83 is a fixed member and the fixing belt 81 slides on the contact surface with the biasing member 83. Preferred materials for the biasing member 83 include resins with a high heat resistance such as liquid crystal polymer (LCP), polyimide, and polyamideimide (PAI); however, metallic materials such as aluminum and stainless steel may be used.

Although not shown, optionally, friction resistance when the fixing belt 81 slides on the biasing member 83 may be reduced by winding a sheet having a low coefficient of friction around the biasing member 83 or by coating the biasing member 83 with a substance having a low coefficient of friction.

The brace 85 preferably is formed of highly rigid metallic materials such as stainless steel and iron, to provide sufficient strength and to allow the biasing member 83 pressing the fixing belt 81 to maintain a suitable shape.

Figure 4:
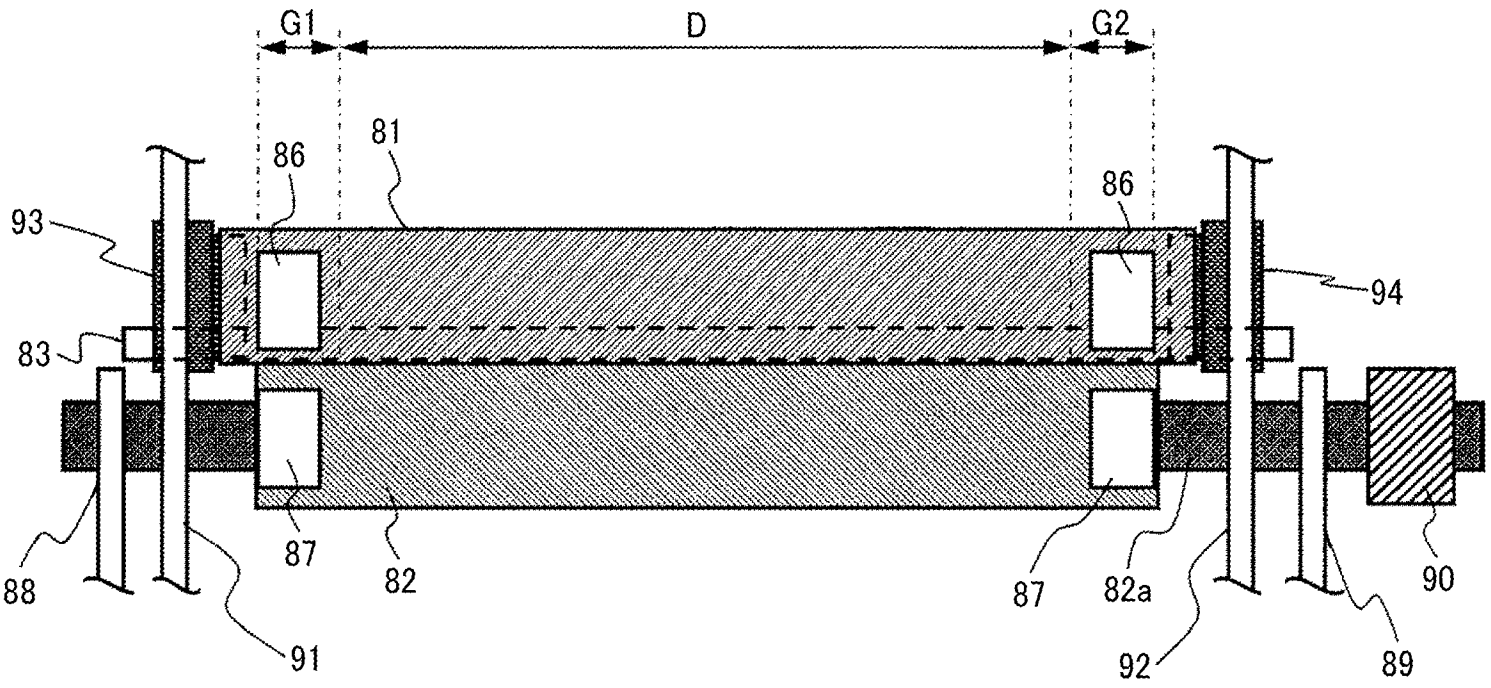
FIG. 4 is a schematic side view of the fixing device.

As illustrated in FIG. 4, the fixing nip 84 formed by cooperation of the fixing belt 81, the pressure roller 82, and the biasing member 83 has a width greater than that of an area D through which the sheet S passes.

With this structure, when the sheet S passes through the fixing nip 84, the fixing belt 81 can be driven to rotate by the pressure roller 82 in areas G1 and G2 where the sheet S does not pass through. As a result, even though the coefficient of friction of the sheet S is small, the fixing belt 81 does not slip and stops relative to the pressure roller 82.

Of note is that the fixing belt 81 and the pressure roller 82 include grip portions G1 and G2 at which the fixing belt 81 and the pressure roller 82 contact each other at portions where the sheet S does not pass (i.e., non-sheet-passing area) in a direction perpendicular to the conveyance direction of the sheet S. In the structure in which the biasing member 83 presses the fixing belt 81 against the pressure roller 82, the rotation torque of the fixing belt 81 is high and slipping tends to occur. However, because the coefficient of friction of the grip portions does not decrease, such slipping is prevented.

Cleaning members 86 and 87 are so disposed as to contact the grip portions G1 and G2. The cleaning members 86 and 87 remove foreign particles such as powdery dust and oil accumulating on the surface of the grip portions of the fixing belt 81 and the pressure roller 82 through the operation of the fixing device and prevent the coefficient of friction of the grip portions from decreasing due to such foreign particles.

When, in particular, the release layer existing on the outer circumference of the fixing belt 81 and the pressure roller 82 is formed of fluorine resins such as PFA, and PTFE, the release layer is gradually scraped off due to the continued operation of the fixing device, resulting in powdery dust. The powdery dust is slippery and if such dust is accumulated in the grip portion, the coefficient of friction of the surfaces of the fixing belt 81 and the pressure roller 82 is greatly reduced. As a result, removing the powdery dust to recover the coefficient of friction is greatly effective for preventing slipping of the fixing belt 81 relative to the pressure roller 82.

The cleaning members 86 and 87 may be brush-shaped or roller-shaped; however, blade-shaped one is so disposed as to slide on the grip portions according to the present embodiment, so that the whole structure is simplified. In addition, the surface of the grip portions is slid and worn little by little, so that the outer circumference of the grip portions is eventually renewed and worn and the coefficient of friction is maintained in a constant range. As a result, the coefficient of friction of the outer circumference of the fixing belt 81 and the pressure roller 82 can be maintained optimally.

A contact angle and load of the cleaning members 86 and 87 relative to the fixing belt 81 and the pressure roller 82 are appropriately set so that a removal rate of the powdery dust and oil and an abrasion speed of the outer circumference of the fixing belt 81 and the pressure roller 82 remain within appropriate values. In particular, because the release layer of the fixing belt 81 and the pressure roller 82 would be at risk of dissipating during operation of the fixing device, the abrasion speed of the outer circumference of the fixing belt 81 and the pressure roller 82 is determined considering the thickness of the release layer.

In the present embodiment, the release layer disposed on the outer circumference of the fixing belt 81 and the pressure roller 82 exists over the whole axial direction and the thickness thereof is substantially uniform over the whole range. To enable such a configuration, the release layer may be formed on the fixing belt 81 and the pressure roller 82 by tube covering method or coating method. As a result, the pressure roller 82 and the fixing belt 81 with higher toner releaseability may be produced at low cost.

However, the release layer need not necessarily be provided on the grip portions. The coefficient of friction of the surface of the elastic layer is in general larger; therefore it is also recommended to remove the release layer from the grip portions so that the force of friction of the pressure roller 82 relative to the fixing belt 81 in the grip portions can be increased.

The pressure roller 82 performs contacting and separating operation as indicated by an arrow pointing to the right and left by a predetermined external operation, as illustrated in FIGS. 2 and 3. With this configuration, the pressure at the fixing nip 84 can be adjusted.

If the sheet S stops while passing though the fixing nip 84, the sheet S can be removed easily because the pressure roller 82 moves in the separating direction from the fixing belt 81. Herein, mounting position of the cleaning member 87 is appropriately controlled so as not to bite the pressure roller 82 excessively, by using a spring if needed.

The biasing member 83 is fixed to the side plates 91 and 92. In addition, although not shown in FIG. 4, the brace 85 is also fixed to the side plates 91, 92. In this case, the brace 85 preferably contacts a rear surface of the biasing member 83 over a wide area thereof so as to keep the biasing force of the biasing member 83 in an appropriate range.

End flanges 93, 94 are fixed to the side plates 91, 92, respectively. The end flanges 93, 94 contact internally both ends in the axial direction of the fixing belt 81 and the fixing belt 81 slides along the inner periphery of the end flange 93, 94 so that the belt shape is generally maintained. In addition, the end flanges 93, 94 also serve to prevent the fixing belt 81 from walking.

The pressure roller 82 includes a metal core 82*a* that is rotatably supported by support members 88, 89 via bearings. When the support members 88, 89 move relative to the side plates 91, 92, the pressure roller 82 is configured to contact or separate from the fixing belt 81. A drive gear 90 is fixed to the metal core 82*a* of the pressure roller 82, and the pressure roller 82 rotates when the drive gear 90 is driven. Further, a driving torque is transmitted to the fixing belt 81 via the fixing nip 84, so that the fixing belt 81 is driven and rotates.

Next, a second embodiment will be described with reference to FIGS. 5 to 8. The same reference numerals will be given to the same parts as described in the first embodiment and redundant, detailed description concerning their structure and function will be omitted unless necessary.

Figure 5:
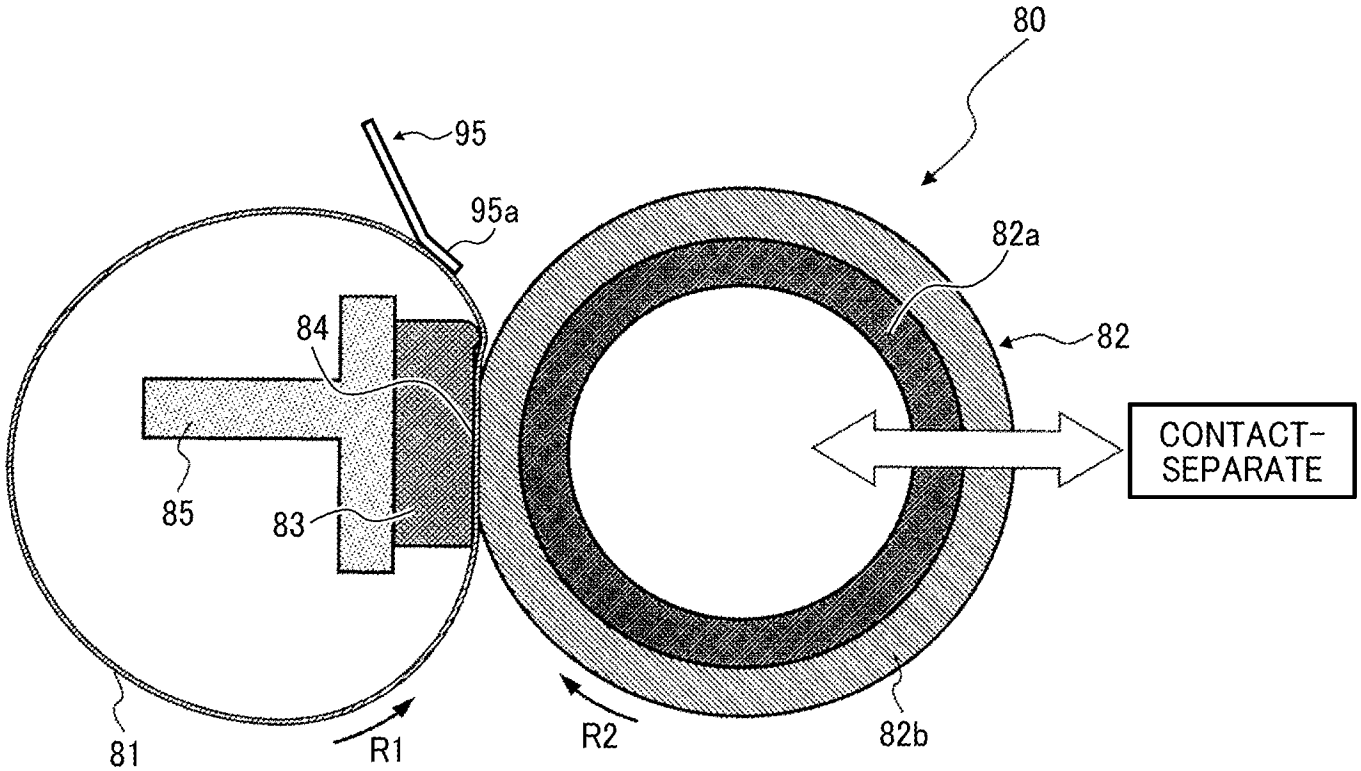
FIG. 5 is a cross-sectional view of a fixing device according to a second embodiment illustrating a positional relation between a cleaning member and a fixing belt.
Figure 7:
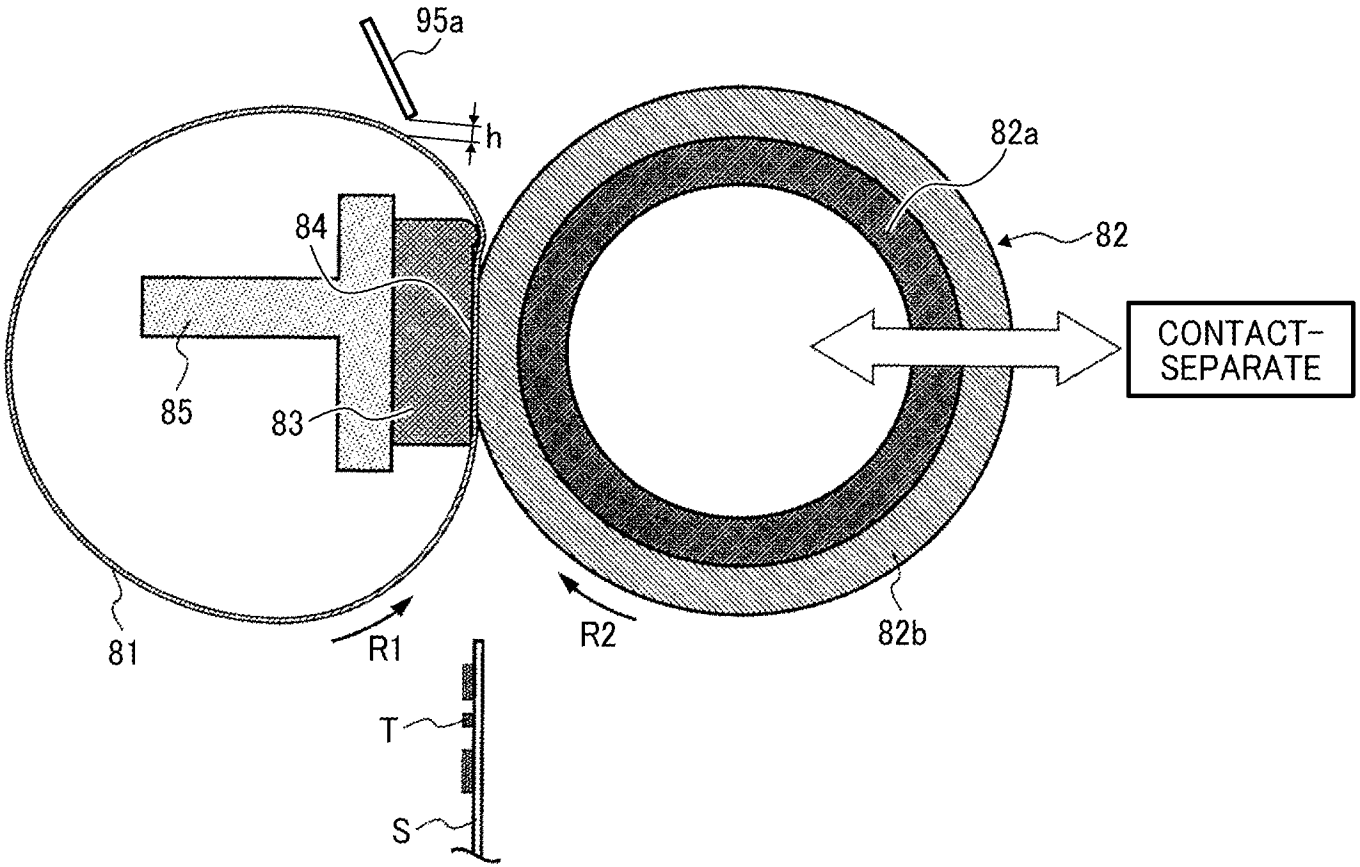
FIG. 7 is a cross-sectional view of the separation member illustrating a separation gap.
Figure 8:
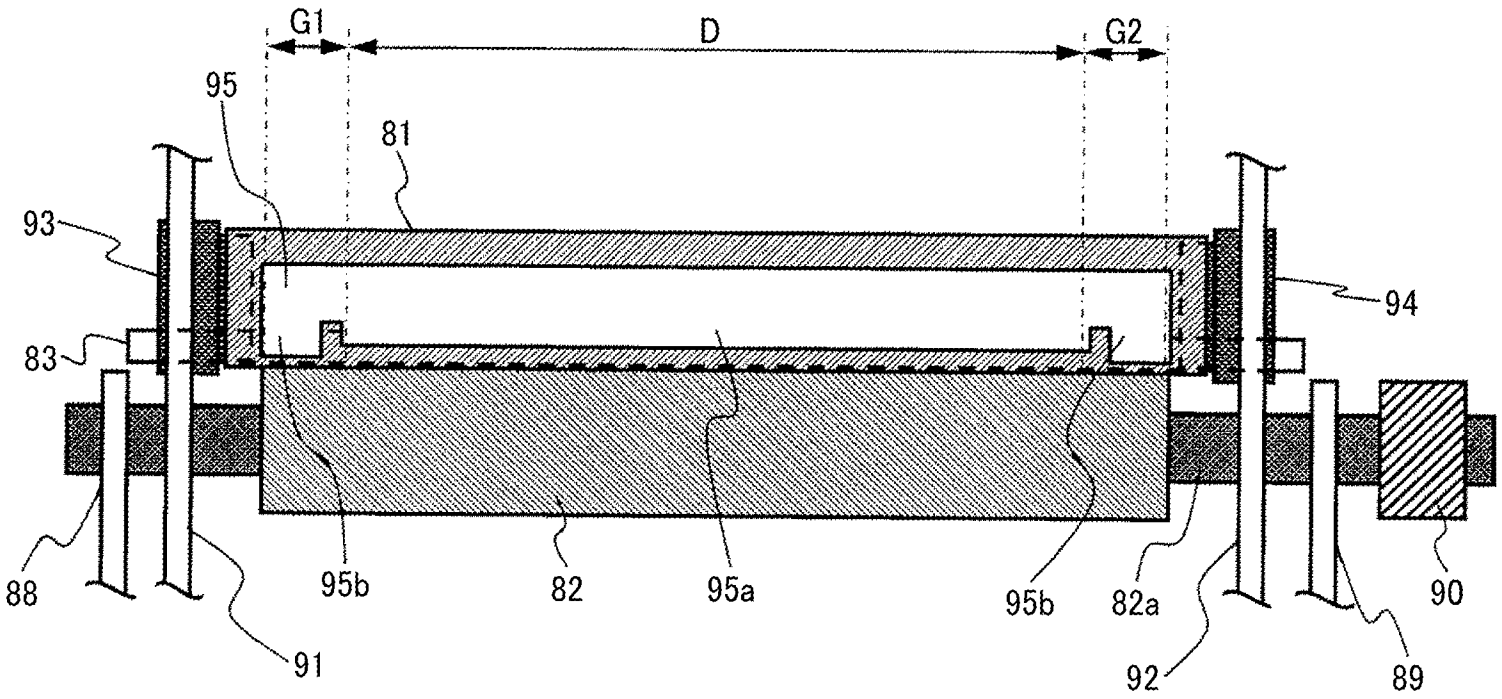
FIG. 8 is a side view of the fixing device according to the second embodiment of the present invention.

FIG. 5 is a cross-sectional view at areas G1 and G2 through which the recording medium does not pass. FIG. 7 is a cross-sectional view of the fixing device at an area D where recording medium passes through.

Figure 6:
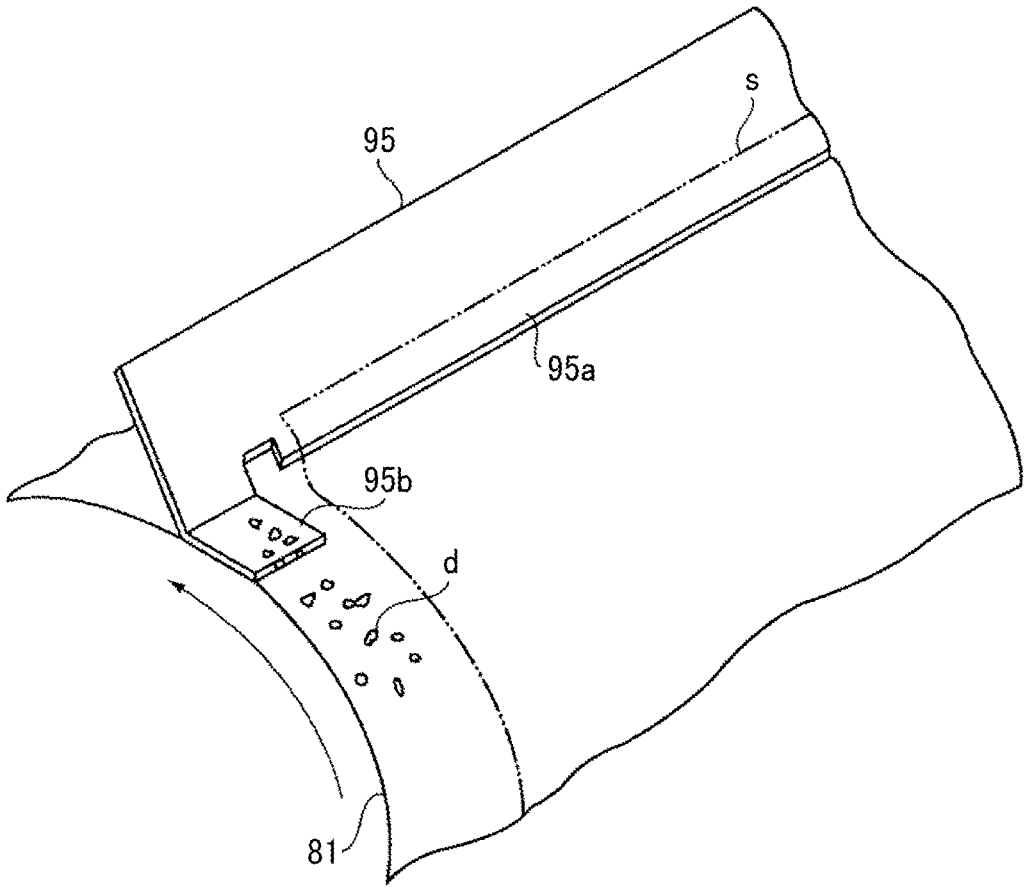
FIG. 6 is an oblique view of a separation member serving also as a cleaning member.

A cleaning member 95*b* shown in FIGS. 5-7 is configured to maintain the coefficient of friction of the grip portions of the fixing belt 81. The second embodiment is different from the first embodiment in which the cleaning member 95*b* is a part of a separation member 95 which separates the sheet S from the fixing belt 81. In the second embodiment, the separation member and the cleaning member for the pressure roller 82 are not shown or the description thereof is omitted; however, the pressure roller 82 is basically configured similarly to the fixing belt 81.

As illustrated in FIG. 7, the separation member 95 is disposed across a minute separation gap h relative to the fixing belt 81 in the fixing nip 84 at downstream of the area D where the sheet S passes through. Even though the sheet S is conveyed attaching to the fixing belt 81 due to the melted and fused toner in the fixing nip 84, a leading end of the sheet S includes a blank portion where no toner is attached, and thus, the leading end portion of the sheet S is floating free of the fixing belt 81. The leading end 95*a* of the separation member 95 is inserted between the floating portion of the sheet S and the fixing belt 81, thereby separating the sheet S while being conveyed from the fixing belt 81.

The separation gap h of the separation member 95 relative to the fixing belt 81 is preferably as small as possible so that the sheet S can be separated from the fixing belt 81 even though the blank area set at the leading end of the sheet S is small. However, if the separation member 95 contacts the fixing belt 81, friction occurs on the outer circumferential surface of the fixing belt 81, which adversely affects fixability of the toner on the sheet S in the fixing nip 84 and the image quality of the printed image is degraded.

In particular, position of the fixing device according to the present embodiments is regulated by the fixing nip 84 alone. Accordingly, when the fixing belt 81 does not describe a true circle, positional oscillation of the outer circumferential surface of the fixing belt 81 increases according to the rotation, and thus, the separation member 95 tends to collide with the fixing belt 81. Accordingly, precaution is required in positioning the separation member 95 relative to the fixing belt 81.

In the present embodiment, as illustrated in FIG. 6, a cleaning member 95*b* is made a part of the separation member 95 and the cleaning member 95*b* is configured to contact the fixing belt 81 in the grip portions. Because the sheet S does not pass through the grip portions, there is no need of considering degrading of fixability due to abrasion of the outer circumferential surface of the fixing belt 81. On the other hand, the shape of the separation member 95 is appropriately designed with reference to the position of the cleaning member 95*b* in the area D where the sheet S passes through, so that the separation gap h may be minimized reliably.

Further, even when the fixing belt 81 is oscillated according to the rotation, because the position of the cleaning member 95*b* contacting the fixing belt 81 moves following the moving of the fixing belt 81, a shifted amount of the separation gap h can be reduced. According to the above effects, even though the separation gap h is designed to be minimal, the separation member 95 is prevented from contacting the fixing belt 81 in the area D where the sheet S passes through. Thus, when part of the separation member is configured to contact the fixing belt or the opposing member, precision positioning of the separation member relative to the fixing belt is improved. The cleaning member as part of the separation member is made to contact the fixing belt 81, thereby reducing the number and the cost of parts.

Additional modifications and variations of the present invention are possible in light of the above teachings. It is therefore to be understood that, within the scope of the appended claims, the invention may be practiced other than as specifically described herein.

What is claimed is:

1. A fixing device to fix an unfixed image onto a recording medium, comprising:

an endless, rotary fixing member;

a heat source to heat the fixing member;

an opposed member disposed opposite the fixing member and configured to form a fixing nip in combination with the fixing member, wherein the opposed member rotates and the fixing member driven by the opposed member rotates so that the recording medium carrying the unfixed image is conveyed to the fixing nip and the unfixed image thereon is fixed onto the recording medium;

a biasing member disposed opposite the opposed member with the fixing member interposed therebetween, to press the fixing member from a back side of the fixing member against the opposed member at the fixing nip, wherein the fixing member slides along a contact surface with the biasing member;

grip portions of the fixing member and the opposed member at which the fixing member and the opposed member contact each other in areas through which the recording medium does not pass, located among the fixing nip along a direction perpendicular to a conveyance direction of the recording medium; and cleaning members to clean the grip portions of the fixing member and the opposed member.

2. The fixing device as claimed in claim 1, wherein the cleaning members contact the outer circumference of the grip portion with pressure sufficient to prevent a coefficient of friction thereof from decreasing.

3. The fixing device as claimed in claim 2, further comprising a separation member integrated with the cleaning member to separate the recording medium passing through the fixing nip from at least one of the fixing member and the opposite member.

4. The fixing device as claimed in claim 1, wherein one of fixing member and the opposed member has an outer layer of fluorine resin.

5. The fixing device as claimed in claim 4, wherein the fluorine resin layer of one of the fixing member and the opposed member has a substantially uniform thickness.

6. An image forming apparatus comprising a fixing device as claimed in claim 1.

7. The fixing device as claimed in claim 1, wherein the cleaning members are at least one of brush-shaped and roller-shaped.

8. The fixing device as claimed in claim 1, wherein the cleaning members are aligned one above the other in a direction perpendicular to a conveyance direction of the recording medium.

9. The fixing device as claimed in claim 1, wherein a contact angle and load of the cleaning members relative to the fixing member and the opposed member are set so that a removal rate of foreign particles and an abrasion speed of an outer circumference of the fixing member and the opposed member remain within set values.

10. The fixing device as claimed in claim 9, wherein the abrasion speed of the outer circumference of the fixing member and the opposed member is in accordance with a thickness of a release layer.

11. The fixing device as claimed in claim 1, further comprising a release layer on an outer circumference of the fixing member and the opposed member.

12. The fixing device as claimed in claim 11, wherein the release layer is formed of fluorine resins.

13. The fixing device as claimed in claim 12, wherein the fluorine resins are at least one of tetrafluoroethylene-perfluoroalkyl vinylether copolymer (PFA), polytetrafluoroethylene (PTFE), polyimide, polyetherimide, and polyethersulfide (PES).

14. The fixing device as claimed in claim 12, wherein the release layer has a thickness from 3 μm to 50 μm.

15. The fixing device as claimed in claim 1, further comprising a brace to prevent the biasing member from deforming thereof.

16. The fixing device as claimed in claim 15, wherein the brace and the biasing member are fixed to side plates.

17. The fixing device as claimed in claim 16, further comprising end flanges disposed at ends of the fixing member.

18. The fixing device as claimed in claim 17, wherein the end flanges are fixed to the side plates, respectively.

19. The fixing device as claimed in claim 17, wherein the end flanges contact internally both ends in an axial direction of the fixing member.

20. The fixing device as claimed in claim 15, wherein the brace contacts a rear surface of the biasing member over a wide area thereof so as to keep a biasing force of the biasing member in a set range.

* * * * *